United States Patent [19]

Jenkins et al.

[11] 3,939,773

[45] Feb. 24, 1976

[54] SPIN-STABILIZED PROJECTILES

[75] Inventors: Dennis H. Jenkins; Luis Palacio, both of Newport, Vt.

[73] Assignee: Space Research Corporation, Montreal, Canada

[22] Filed: Mar. 6, 1974

[21] Appl. No.: 448,565

Related U.S. Application Data

[63] Continuation-in-part of Ser. No. 127,321, March 23, 1971, abandoned.

[30] Foreign Application Priority Data

Mar. 12, 1973 Sweden ..... 7303390

[52] U.S. Cl. ..... 102/93

[51] Int. Cl.[2] ..... F42B 13/00

[58] Field of Search ..... 102/93

[56] References Cited

UNITED STATES PATENTS

| | | | |
|---|---|---|---|
| 3,695,181 | 10/1972 | Bull et al. | 102/93 |
| 3,769,912 | 11/1973 | Friend | 102/93 |

FOREIGN PATENTS OR APPLICATIONS

| | | | |
|---|---|---|---|
| 1,016,766 | 9/1952 | France | 102/93 |
| 1,231,601 | 4/1960 | France | 102/93 |

*Primary Examiner*—Samuel Feinberg
*Assistant Examiner*—C. T. Jordan
*Attorney, Agent, or Firm*—Stevens, Davis, Miller & Mosher

[57] ABSTRACT

A gun-fired spin-stabilized projectile of good aerodynamic shape (i.e. with a long forward tapering section) is centered in the gun barrel at its forward end by means of a series of circumferentially spaced apart permanently fixed radially extending projections, and at its rearward end, by means of either the maximum diameter of the projectile body or by means of a driving band mounted on a rear portion of the body. In the latter case, the maximum diameter of the projectile body is slightly less than the diameter lands of the gun and the driving band is constructed in such a manner as to be separated from the body after firing by centrifugal force and air drag.

10 Claims, 7 Drawing Figures

SPIN-STABILIZED PROJECTILES

Figure 1:
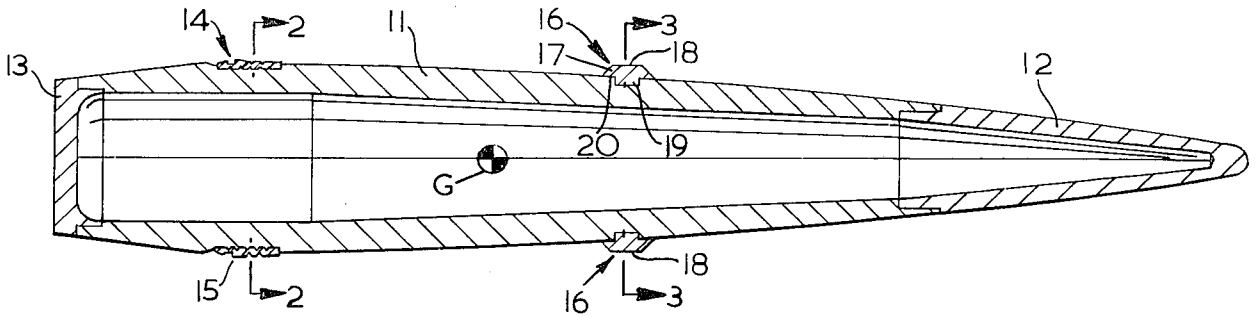

This is a continuation-in-part of U.S. Pat. Application Ser. No. 127,321 filed March 23, 1971 now abandoned.

This invention relates to spin-stabilized projectiles which are fired from guns.

With modern gun-fired spin stabilized projectiles, it is difficult to provide a design which satisfies optimum requirements for firing from a gun barrel on the one hand and for aerodynamic performance on the other hand. Good aerodynamic performance requires a relatively long forward tapering section, but such a configuration is not particularly suitable for firing from a gun.

It is known to provide sabots, which are annular devices surrounding the exterior of a projectile to bridge the gap between the projectile and the wall of the gun barrel, and thereby correctly center the projectile in the barrel. Sabots are constructed so as to separate from the projectile under the action of centrifugal force and air drag, when the projectile emerges from the barrel. However, in some circumstances sabots are a hazard.

It is also known to provide projectiles with annular devices which do not separate therefrom after firing, but such devices cause considerable air drag which adversely affects the flight of the projectile.

According to the invention, a driving band is mounted on a rear portion of the longitudinally extending body of the projectile and is engageable with rifling in a gun barrel during firing to cause spin to be imparted to the projectile. The body tapers smoothly from a maximum diameter forwardly of the driving band to the forward end of the body, and the tapering portion carries a series of circumferentially spaced apart, permanently fixed, radially-extending projections. Each projection has an outer surface parallel to the longitudinal axis of the body and engageable with the wall of the gun barrel to center the forward portion of the projectile therein. The projections are shaped to minimize air drag during flight of the projectile after firing, and the major part of the radial extent of the projections lies within the maximum diameter of the body.

Preferably, the projections are axially elongated in the direction of travel of the projectile compared to their width, and are also preferably skewed with respect to the longitudinal axis of the projectile.

The maximum diameter of the projectile preferably lies immediately forward of the driving band, with the maximum diameter being slightly less than the diameter of the outer surfaces of the projections so that the body does not engage the wall of the gun barrel during firing.

The driving band may be of deformable non-metallic material to cause parts of the driving band to be forced into the rifling grooves in a gun barrel. The driving band may be constructed to be separated from the body after firing by centrifugal force and/or air drag. For this purpose, the driving band may have a series of circumferentially spaced slots extending rearwardly from the forward end thereof to facilitate such separation.

The driving band may be mounted on a rearwardly tapering rear portion of the body, and a boat-tail may be detachably secured to the rear end of the body, the boat-tail having an external surface forming a continuation of the external surface of the rear portion of the body.

Figure 4:
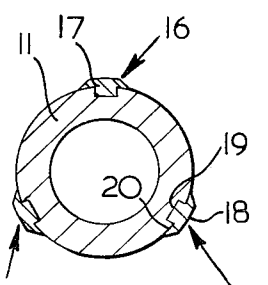
Figure 3:
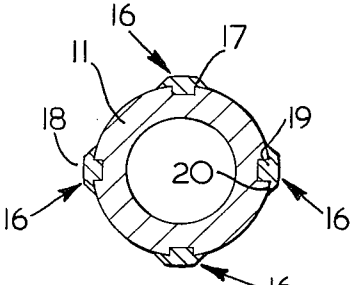
Figure 2:
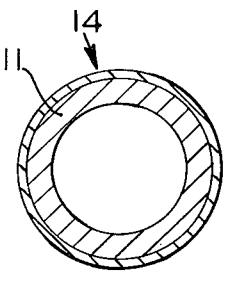
Figure 5:
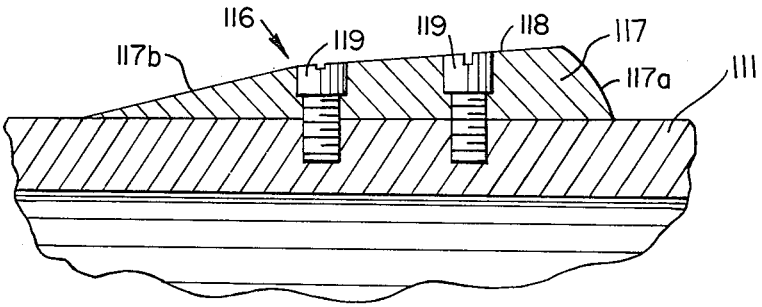
Figure 6:
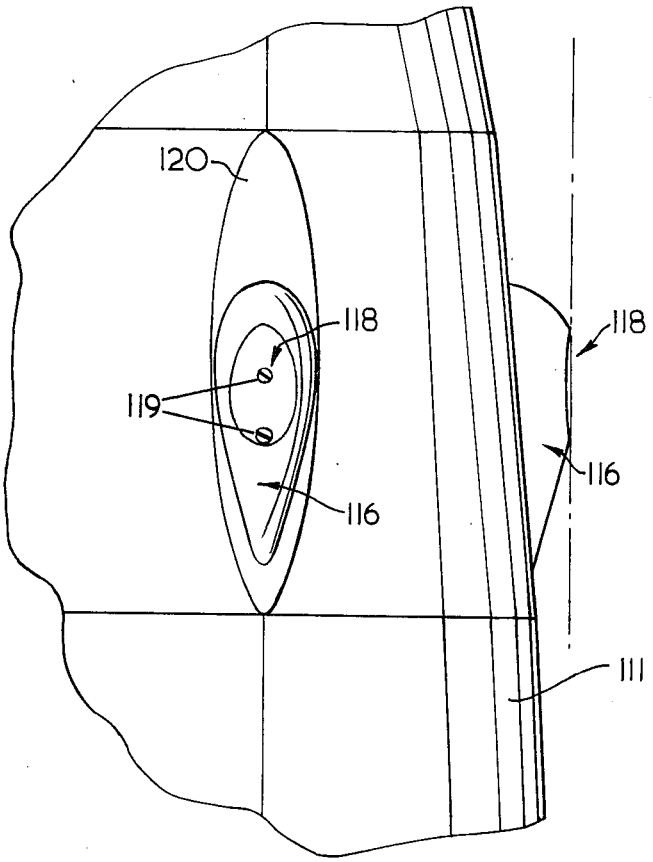
Figure 7:
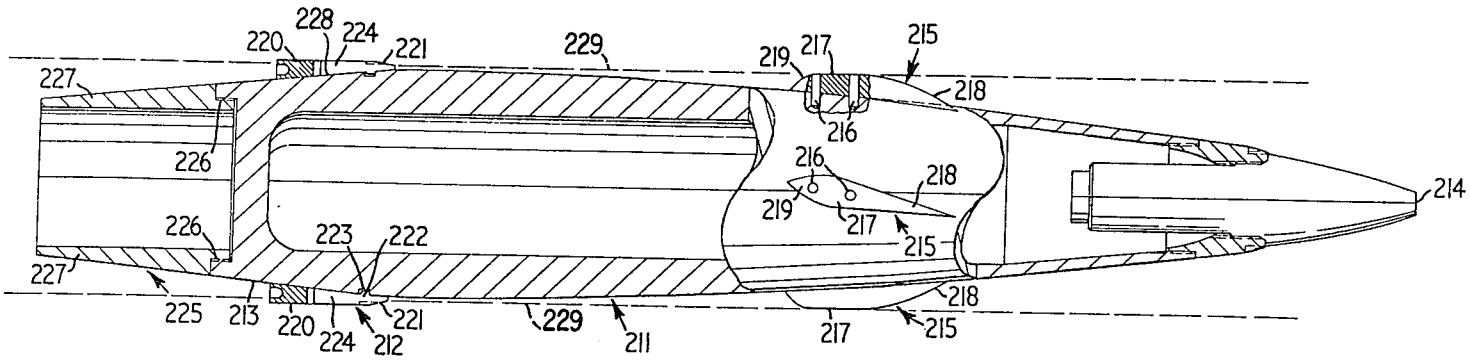

Embodiments of the present invention will now be described, by way of example, with reference to the accompanying drawings, of which:

FIG. 1 is a longitudinal sectional view of a projectile, according to one embodiment, FIG. 2 is a sectional view along the line 2—2 of FIG. 1, FIG. 3 is a sectional view along the line 3—3 of FIG. 1, FIG. 4 is a sectional view similar to FIG. 3, but showing a second embodiment, FIG. 5 is a longitudinal sectional view of part of a projectile according to a third embodiment, FIG. 6 is a plan view of the part of the projectile shown in FIG. 5, and FIG. 7 is a longitudinal view, partly in section, of a fourth embodiment.

Referring first to FIGS. 1 to 3, a projectile has a body including a main body portion 11, a nose portion 12 screwed into the forward end of the main body 11, and a rear cap 13 screwed into the rear end of the main body 11. The center of gravity of the projectile is shown at G.

Approximately mid-way between the center of gravity G and the rear end, the main body 11 is of substantially full bore size, that is to say has a diameter corresponding to the diameter of the gun barrel from which the projectile is to be fired, and at this position the main body 11 carries an annular bore rider 14 seated in and projecting from an annular groove in the main body 11. The bore rider 14 has an annular ridge 15 which engages rifling in the gun barrel to effect spinning of the projectile during firing, and also provides an effective gas seal. Rearwardly of the bore rider 14, the main body 11 tapers toward the rear end.

Forwardly of the bore rider 14, the main body 11 tapers toward the forward end, and this taper continues through the nose portion 12 to its forward end. At a position forwardly of the center of gravity G, the main body 11 carries four radially-extending circumferentially equally-spaced projections 16. Each projection 16 has a body 17 of frusto-conical shape with an outer surface 18 parallel to the longitudinal axis of the projectile. The frusto-conical shape provides a circular cross-section in a plane tangential to the projectile. The outer surface 18 is curved to correspond with the internal surface of the gun barrel from which the projectile is to be fired, and the surface 18 has a width equal to at least two or three rifling lands, a land being of course the distance on the inner surface of the gun barrel between two adjacent rifling grooves. The outer surfaces 18 thus lie on a circle of substantially full bore diameter.

Each projection 16 also has a root 19 extending from the base of the frusto-conical body 17. The root 19 is screw-threaded and engaged in a correspondingly shaped screw-threaded recess in the projectile body 11. The root 19 is of smaller diameter than the bottom surface of the body 17, and an annular portion 20 of the bottom surface of the body 17 surrounds the root 19, and engages the outer surface of the projectile body 11.

FIG. 4 shows a modified embodiment with three equally spaced projections 16, instead of four as in the previous embodiment.

When the projectile is fired from a gun, the projections 16 slidingly engage the wall of the gun barrel and center the projectile therein. The ridge 15 of the bore rider 14 engages the rifling in the gun barrel, and spin is thereby imparted to the projectile. The projections 16 are retained by the projectile during flight, and because of their streamlined shape do no adversely affect the flight.

FIGS. 5 and 6 show another type of projection 116. Each projection 116 has a body 117 with a substantially oval crosssection in the tangential plane and an outer curved surface 118. The body 117 has a forward portion 117*a* of part-spherical shape which merges rearwardly into a tapering tail 117b. The body 117 is secured to the projectile body 111 by two longitudinally-spaced screws 119, and is mounted on a surface 120 of the projectile body 111 which has been machined flat.

FIG. 7 shows a further embodiment. The gun-fired spin-stabilized projectile shown therein has a longitudinally-extending hollow body 211 of circular cross-section, which carries a driving band 212 on a rearwardly-tapering rear portion 213. Immediately forward of the driving band 212, the body 211 commences to taper forwardly in a slightly-curved manner, and the forward taper extends from the driving band 212 to the nose 214 of the body 211. The maximum body diameter therefore occurs immediately in front of the driving band 212, and the curved forward taper therefore extends over a major part of the length of the body 211. The maximum body diameter is slightly less than the diameter of the gun barrel, from which the projectile is to be fired, so that the body itself does not contact the gun barrel.

The forwardly-tapering portion 213 of the body 211 carries four equi-angularly spaced axially-elongated projections 215 which are circumferentially spaced apart by a relatively large distance compared to their width in a direction extending circumferentially of the body 211. The projections 215 are permanently fixed to the body 211, for example by pins 216.

The projections 215 have radially-outer surfaces 217 extending parallel to the longitudinal axis of the body 211 and shaped for engagement with the wall of the gun barrel. The gun barrel will of course have rifling grooves, and the radially-outer surfaces 217 of the projections 215 will engage the lands between the rifling grooves. The diameter of the lands is indicated by the dotted lines 229. The projections 215 are preferably dimensioned so that they ride on at least three rifling lands.

Each projection 215 in side view has a forward upper surface 218 which curves forwardly and downwardly from the radially outer surface 217 to meet the body 211 at the front end of the projection, and a rear upper surface 219 which curves rearwardly and downwardly from the radially outer surface 217 to meet the body 211 at the rear end of the projection. Each projection 215, in plan view, tapers forwardly to a pointed front end from its maximum width, and tapers rearwardly to a pointed rear end from its maximum width, the maximum width being nearer the rear end than the front end of the projection 215.

As previously mentioned, each projection is axially elongated, that is to say it is long compared to its maximum width. Each projection 215 is axially skewed with respect to the longitudinal axis of the projectile, and also its radial height is such that only the radially outermost part of each projection 215 projects beyond the maximum diameter portion of the body 211, which maximum diameter portion lies just forwardly of the driving band 212. Thus, the major part of the height of the projections 215 is within the maximum diameter of the body.

The above described shaping and dimensioning of the projections 215 minimize air drag during flight and also minimize resistance to spin of the projectile during flight. The skewing angle is preferably of the same order as the rifling in the barrel, and in the same direction.

The driving band 212 mounted on the rearwardly tapering body portion 213 is of deformable non-metallic material, for example a synthetic plastic material or ligno-cellulosic material. It will be noted that the diameter of the body 211 is less than the diameter of the rifling lands, which diameter is indicated by the dotted lines 229, even at its point of maximum diameter just forwardly of the driving band 212. There is thus no contact between the body 211 and the wall of the gun barrel. The driving band 212 has a radially outer surface 220 which extends parallel to the longitudinal axis of the body 211 over most of its length, the radially outer surface 220 having a diameter greater than the diameter of the rifling lands, and approximately equal to the diameter of the rifling grooves. The forward part of the driving band 212 has a forwardly tapering surface 221 to facilitate entry of the projectile into a gun barrel.

Thus, when the projectile is inserted into the gun barrel, the radially outer surfaces 217 of the forwardly mounted projections 215 ride on the rifling lands to center the forward portion of the projectile in the gun barrel, and the driving band 212 centers the rear portion of the projectile. The radially outermost portion of the driving band 212 is deformed by the rifling, with parts of the driving band entering the rifling grooves, so that when the projectile is fired spin is imparted to the driving band 212, and hence to the remainder of the projectile. To assist in imparting spin to the projectile body 211, the cooperating surfaces of the driving band 212 and the rearwardly tapering body portion 213 are knurled or otherwise shaped at 228 to cause the surfaces to interengage. The provision of such interengaging surfaces also enables thrust, as well as spin, to be transmitted from the driving band 212 to the body 211. The driving band 212 also of course acts as a gas seal during firing.

To assist in retaining the driving band 212 on the rear portion 213 before firing, the driving band 212 has an inwardly projecting annular rib 222 near its forward end which is located in an annular groove 223 in the rear body portion 213.

The driving band 212 is also constructed so that it will leave the projectile body 211 after firing. To assist with this, the forward part of the driving band 212 has a series of circumferentially spaced axially extending slots 224. When the rear end of the projectile leaves the gun barrel, the centrifugal force acting on the driving band 212 due to the projectile spin and also the air drag causes the driving band 212 to fragment into small parts and thus leave the projectile body 211. The absence of the driving band 212 in flight of the projectile reduces drag. Also, it has been found that use of the discarding driving band 212 enables the diameter of the body 211 to be reduced by a small amount from what it would have to be otherwise, thereby enabling drag to be still further reduced.

The rear end of the rear body portion 213 has an internal screw thread, which receives an external screw thread on the forward end of a removable boat-tail 225, the screw threads being indicated at 226. The boat-tail 225 is in the form of a hollow cylinder with a rearwardly tapering outer surface 227 which forms a continuation of the tapering rear portion 213 of the projectile body 211. The projectile can be fired with or without the boat-tail 225 accordingly to the circumstances.

When long range and consequently high velocity is required, the boat-tail 225 is used to reduce the drag and accordingly increase the range. The boat-tail 225 does not have a significantly adverse effect on the stability of the projectile under these conditions, since the projectile will have more than the required gyroscopic stability at such high velocity.

On the other hand, when short range and consequently low velocity is required, the boat-tail 225 can be removed to increase stability. Removal of the boat-tail 225 also increases drag, but this is not important for a short range requirement.

We claim:

1. A gun-fired spin-stabilized projectile having a longitudinally extending body, a driving band mounted on a rear portion of the body and being engageable with rifling in a gun barrel during firing to cause spin to be imparted to the projectile, said body tapering smoothly from a maximum diameter forwardly of the driving band to the forward end of the body, said tapering portion carrying a series of circumferentially spaced apart, permanently fixed, radially-extending projections, each projection having an outer surface parallel to the longitudinal axes of the body and engageable with the wall of the gun barrel to center the forward portion of the projectile therein, and also being shaped to minimize air drag during flight of the projectile after firing, and the major part of the radial extent of the projections lying within the maximum diameter of the body.

2. A projectile according to claim 1 wherein the projections are axially elongated in the direction of travel of the projectile compared to their width.

3. A projectile according to claim 2 wherein the elongated projections are skewed with respect to the longitudinal axis of the projectile.

4. A projectile according to claim 1 wherein the maximum diameter of the projectile body lies immediately forward of the driving band.

5. A projectile according to claim 4 wherein the maximum diameter is slightly less than the diameter of the outer surfaces of the projections so that the body does not engage the wall of the gun barrel during firing.

6. A projectile according to claim 1 wherein the driving band is of deformable non-metallic material to cause parts of the driving band to be forced into rifling grooves in a gun barrel.

7. A projectile according to claim 6 wherein the driving band is constructed to be separated from the body after firing by centrifugal force and air drag.

8. A projectile according to claim 7 wherein the driving band has a series of circumferentially spaced slots extending rearwardly from the forward end thereof to facilitate said separation.

9. A projectile according to claim 1 wherein the driving band is mounted on a rearwardly tapering rear portion of the body.

10. A projectile according to claim 1 wherein a boat-tail is detachably secured to the rear end of the body, said boat-tail having an external surface forming a continuation of the external surface of the rear portion of the body.

* * * * *